US006291407B1

(12) United States Patent
Reidmeyer

(10) Patent No.: US 6,291,407 B1
(45) Date of Patent: Sep. 18, 2001

(54) AGGLOMERATED DIE CASTING LUBRICANT

(75) Inventor: Mary R. Reidmeyer, Freeburg, MO (US)

(73) Assignee: LaFrance Manufacturing Co., Maryland Heights, MO (US)

( * ) Notice: Subject to any disclaimer, the term of this patent is extended or adjusted under 35 U.S.C. 154(b) by 0 days.

(21) Appl. No.: 09/492,732

(22) Filed: Jan. 27, 2000

Related U.S. Application Data

(63) Continuation-in-part of application No. 09/392,006, filed on Sep. 8, 1999, now abandoned.

(51) Int. Cl.[7] ..... C10M 125/00; B28B 7/36

(52) U.S. Cl. ..... 508/114; 508/116; 508/130; 508/131; 508/142; 508/148; 508/155; 508/167; 106/38.22; 164/72

(58) Field of Search ..... 508/114

(56) References Cited

U.S. PATENT DOCUMENTS

| | | | |
|---|---|---|---|
| 1,948,194 | 2/1934 | Williams | 205/21 |
| 2,045,913 | 6/1936 | Hoy et al. | 22/192 |
| 2,126,128 | 8/1938 | Montgomery | 113/51 |
| 2,234,076 | 3/1941 | Gumlich et al. | 260/93 |
| 2,319,393 | 5/1943 | Epstein et al. | 252/39 |
| 2,334,076 | 11/1943 | Epstein et al. | 252/22 |
| 2,530,838 | 11/1950 | Orozco et al. | 252/25 |
| 2,618,032 | 11/1952 | Traenkner | 22/192 |
| 2,625,491 | 1/1953 | Young et al. | 106/270 |
| 2,682,523 | 6/1954 | Talley et al. | 252/49.5 |
| 2,923,041 | 2/1960 | Ryznar | 22/192 |
| 2,923,989 | 2/1960 | Thomson | 22/193 |
| 3,012,960 | 12/1961 | Anastasoff | 208/31 |
| 3,059,769 | 10/1962 | Frost | 207/10 |
| 3,125,222 | 3/1964 | Foerster et al. | 207/10 |
| 3,242,075 | 3/1966 | Hunter | 252/22 |
| 3,258,319 | 6/1966 | Cox | 29/195 |
| 3,342,249 | 9/1967 | Ulmer et al. | 164/72 |
| 3,423,279 | 1/1969 | Grover | 161/189 |
| 3,577,754 | 5/1971 | Calmes | 72/45 |
| 3,600,309 | 8/1971 | Loser et al. | 252/12 |
| 3,607,747 | 9/1971 | Ishikawa | 252/18 |
| 3,645,319 | 2/1972 | Pondelicek et al. | 164/72 |
| 3,654,985 | 4/1972 | Scott | 164/72 |
| 3,725,274 | 4/1973 | Orozco | 252/18 |
| 3,735,797 | 5/1973 | Jeanneret | 164/72 |
| 3,761,047 | 9/1973 | Mao | 249/115 |
| 3,779,305 | 12/1973 | Pondelicek et al. | 164/312 |
| 3,830,280 | 8/1974 | Larsen | 164/72 |
| 3,895,899 | 7/1975 | Weber et al. | 425/378 R |
| 3,963,502 | 6/1976 | Borbely et al. | 106/38.28 |
| 3,978,908 | 9/1976 | Klaus et al. | 164/72 |
| 4,118,235 | 10/1978 | Horiuchi et al. | 106/38.22 |
| 4,210,259 | 7/1980 | Schrecker | 220/455 |
| 4,283,931 | 8/1981 | Pigott et al. | 72/45 |
| 4,308,063 | 12/1981 | Horiuchi et al. | 106/38.22 |
| 4,403,490 | 9/1983 | Sargent | 72/42 |
| 4,425,411 | 1/1984 | Textor et al. | 428/702 |
| 4,457,879 | 7/1984 | Adelmann et al. | 264/0.5 |
| 4,575,430 | 3/1986 | Périard et al. | 252/12.6 |
| 4,628,985 | 12/1986 | Jacoby et al. | 164/72 |
| 4,766,166 | 8/1988 | Upadhyaya | 524/275 |

(List continued on next page.)

FOREIGN PATENT DOCUMENTS

| | | |
|---|---|---|
| 2641898 | 10/1978 | (DE) . |
| 3211529 | 10/1982 | (DE) . |
| 3720841 | 1/1988 | (DE) . |
| 2095696 | 10/1982 | (GB) . |
| 56-099062 | 8/1981 | (JP) . |
| 61-276733 | 12/1986 | (JP) . |
| 63-129367 | 5/1988 | (JP) . |
| 63-129368 | 5/1988 | (JP) . |
| 63-265996 | 11/1988 | (JP) . |
| 150989 | 6/1961 | (SU) . |
| 850256 | 7/1981 | (SU) . |
| 1127683 | 12/1984 | (SU) . |
| 1139559 | 2/1985 | (SU) . |

OTHER PUBLICATIONS

Dr. David B. Cox, "Die Casting Lubricants of the Future," Die Casting Engineer, Jan./Feb. 1986.

Jack J. Smith, Jr., "Choosing Between Wax and Oil Based Lubes," Die Casting Engineer, Jan./Feb. 1986.

W.J. Mechlenburg, "Nongraphite High–Temperature Lubricants," Die Casting Engineer, Jan./Feb. 1986.

Robert Smith, "Die Lube, Viscosity, and Air Blowoff," Die Casting Engineer, Jan./Feb. 1986.

"Boric acid: A self–replenishing solid lubricant," Advanced Materials and Processes, Jul., 1991.

Ali Erdemir, "Tribological Properties of Boric Acid and Boric–Acid Forming Surfaces," Lubrication Engineering, Mar. 1991.

Casting Kaiser Aluminum, 1956.

"A standardized Questionaire for Die Casting Lubricants," Die Casting Engineer, Jul./Aug. 1973.

Robert W. Smith, "Everything You Always Wanted to know About Die Casting Release Agents but Were Afraid to Ask," Die Casting Engineer, Jul./Aug. 1973.

The Merck Index, Tenth Edition, 1983.

Kirk–Othmer Encyclopedia of Chemical Technology, vol. 12, Second Edition.

*Primary Examiner*—Ellen M. McAvoy
(74) *Attorney, Agent, or Firm*—Howell & Haferkamp LC

(57) ABSTRACT

A lubricant for use in lubricating the shot sleeve of a machine for die casting molten metals is in the form of agglomerated particles. The particles have an inorganic high pressure lubricant agglomerated, with a binder material and with an organic material. The solid lubricant is resistant to dusting, caking and breakage, can be fed through an automatic dispensing machine, and combines inorganic and organic materials to achieve excellent lubrication properties. The product has low flash and low smoke release into the environment.

21 Claims, No Drawings

U.S. PATENT DOCUMENTS

| | | | |
|---|---|---|---|
| 4,773,845 | 9/1988 | Nagura et al. | 425/592 |
| 4,787,993 | 11/1988 | Nagahiro | 252/18 |
| 4,923,624 | 5/1990 | Albanesi | 252/10 |
| 5,014,765 | 5/1991 | Aoyama | 164/72 |
| 5,033,532 | 7/1991 | Aoyama | 164/72 |
| 5,039,435 | 8/1991 | Hanano | 106/38.22 |
| 5,076,339 | 12/1991 | Smith | 164/72 |
| 5,154,839 | 10/1992 | Hanano | 252/18 |
| 5,252,130 | 10/1993 | Ookouchi et al. | 118/423 |
| 5,385,196 | 1/1995 | Hanano | 164/72 |
| 5,400,921 | 3/1995 | Smith, Jr. et al. | 222/1 |
| 5,468,401 | 11/1995 | Lum et al. | 252/22 |
| 5,480,469 | 1/1996 | Storstrom et al. | 75/228 |
| 5,580,845 | 12/1996 | Ruane | 508/161 |

AGGLOMERATED DIE CASTING LUBRICANT

TECHNICAL FIELD

The present invention relates generally to a novel solid lubricant composition used for lubricating the plunger and the inner surfaces of a shot sleeve or shot chamber of a cold chamber die casting machine and to the method of using the novel lubricant.

This application is a continuation-in-part of application Ser. No. 09/392,006, filed Sep. 8, 1999, and now abandoned.

BACKGROUND OF THE INVENTION

Die casting methods are old in the art. The methods permit continuous manufacturing of die cast products with a high degree of quality, such that the methods are commonly used.

In conventional metallic die casting, molten metal is introduced into a shot sleeve or shot chamber. Generally, the molten metal is superheated before it enters the shot sleeve, and thus is introduced to the shot sleeve at a temperature between about 1100° F. and 1600° F., for aluminum, for example. A plunger then slides into the shot sleeve and forces the molten metal into a die cavity. Increased pressure is required to be exerted by the plunger at the end of the fill cycle to compress and force the molten metal in the casting dies. The overall strength of the piece being die cast is dependent, in part, upon the amount of pressure applied by the plunger and upon the initial temperature of the molten metal and its quality. Frequently, tight tolerances are necessary between the plunger and the shot sleeve to minimize any metal blow by around the plunger tip.

Tight tolerances also have the effect of creating additional friction between the plunger and the shot sleeve walls. Further, mechanical and thermal stresses may add additional friction between the plunger and the shot sleeve wall. It is conventional, in cold chamber die casting, that the inside walls of the shot sleeve are lubricated with a lubricant to counteract the frictional forces. It is a goal of the applied lubrication to minimize the wear of the plunger and shot sleeve walls, to prevent blow by and to permit the die casting process to operate continuously.

Conventional lubricants include both solid and liquid materials of various compositions. The liquids may be aqueous based or oil based and may contain various organic and inorganic lubricants. Solid lubricants may include both organic and inorganic materials. The organic materials include a variety of oils, greases and waxes of both natural and synthetic origin. The inorganic materials may include a variety of high pressure lubricants. For example, the inorganic materials may include talc, various nitrides, such as boron nitride, sulfur compounds, such as molybdenum disulfide, silica compounds and may also include graphite and carbon. The inorganic lubricants in particular are inexpensive and highly effective lubricants, as noted by U.S. Pat. No. 5,014,765. However, these materials are typically commercially available in a finely divided particulate form. This finely divided particulate form presents difficulties in handling and dispensing, requiring special methods of application, and may create airborne dust.

Prior U.S. Pat. No. 5,154,839 attempted to solve the problems created with the use of inorganic solid lubricants. The patent discloses the use of an inorganic granulated lubricant which has been coated with an organic polymer or metal soap. While coating the inorganic lubricant with a polymer or metal soap may reduce the dusting problems experienced with the use of prior solid lubricants, the lubricant disclosed by the patent produces a lubricant which may not maintain the integrity of the particles sufficiently and may not be as desirable for use with metering and dispensing apparatus without caking or blocking.

Organic lubricants, including those containing some inorganic material, have an additional problem. In use, these materials frequently generate an open flame and smoke. Organic materials, such as oils and waxes in conventional lubricants, are volatile and flash under the temperature conditions to which these materials are exposed. Frequently a plume of flame and smoke flashes back through the shot hole when the molten metal comes in contact with the applied lubricant.

Applicant is aware of the following U.S. patents, the disclosures of which are incorporated by reference herein.

| | |
|---|---|
| 3,645,319 | 5,076,339 |
| 3,779,305 | 5,154,839 |
| 5,014,765 | 5,400,921 |

SUMMARY OF THE INVENTION

It is desirable to have a solid lubricant material which doesn't cake and which retains its integrity during shipping and handling. Further, it is desirable that this material have a size distribution and other properties to permit its use in conventional dispensing apparatus without caking and blocking. The composition should preferably be formed of an inorganic and an organic material that can maintain its lubrication properties despite an exposure to high pressures and high temperatures. Furthermore, it is desirable to have a solid powder lubricant which has the aforementioned positive qualities, but yet remains in an agglomerated form capable of being automatically fed to a shot sleeve, with conventional metering equipment, and which will also effectively lubricate the shot sleeve when so introduced.

In accordance with the present invention there is provided a non-caking solid lubricant composition for use in lubricating the inner surfaces of a shot sleeve and plunger for use in the die casting of molten metals using cold chamber die casting machines. The non-caking solid lubricant of the present invention is in the form of durable individual agglomerates. Each agglomerate is preferably formed of finely divided inorganic lubricant material agglomerated around or to a solid organic core with a binder material in such a manner that the lubricant retains its form and integrity during shipping, handling and dispensing. Further, the lubricant effectively lubricates a shot sleeve when introduced therein. It is believed that under the pressure and temperature conditions of the shot sleeve, the agglomerated particles break up and the inorganic lubricant is effectively distributed in the shot sleeve to lubricate the moving parts and surfaces. The high temperature of the shot sleeve may flash the organic content of the agglomerated particles freeing the finely divided inorganic particles from the agglomerate and permitting their distribution in the shot sleeve. These fine particles may be of the materials described herein. The carbon residue from the flashed organic material may also add to the lubricating ability of the material in the shot sleeve.

The organic materials of the present invention may include materials which have an additional, unexpected, advantage in that they produce a lubricant having a suppressed rate of combustion or flash. This low or slow flash results in little or no flash back of smoke and flame from the shot hole when the lubricant is introduced to the shot sleeve and exposed to the high temperature conditions of the shot sleeve and the introduction of molten metal. It is believed that carbonization and flash of the organic portion occurs substantially within the confines of the shot sleeve after the pour hole or shot hole has been closed by movement of the plunger. The carbon produced is effective to lubricate the shot sleeve and plunger, and there is less pollution and waste.

It is an object of this invention to provide a material and method for effectively lubricating the shot sleeve and plunger of a cold chamber die casting machine.

It is an object of this invention to provide a solid material for effectively lubricating the shot sleeve and plunger of a cold chamber die casting machine.

It is an object of this invention to provide a solid material for effectively lubricating the shot sleeve and plunger of a cold chamber die casting machine, the material having a substantial content of inorganic lubricant.

It is an object of this invention to provide a material for effectively lubricating the shot sleeve and plunger of a cold chamber die casting machine, the material being in the form of agglomerated particles of lubricant compounds.

It is an object of this invention to provide a material for effectively lubricating the shot sleeve and plunger of a cold chamber die casting machine, the material being in the form of agglomerated particles of inorganic lubricants and organic lubricants.

It is an object of this invention to provide a material for effectively lubricating the shot sleeve and plunger of a cold chamber die casting machine, the material effectively reducing the flame and smoke generated from the shot hole on introduction of the lubricant.

It is an object of this invention to provide a lubricating material for effectively lubricating the shot sleeve of a cold chamber die casting machine, the material having a reduced flash on introduction to the shot sleeve.

It is an object of this invention to provide a low flash shot sleeve lubricant.

It is an object of this invention to provide a shot sleeve lubricant, containing combustible organic materials, in which the flash rate of those materials on introduction to the shot sleeve of a cold chamber die casting machine, is reduced.

It is an object of this invention to provide a material for effectively lubricating the shot sleeve and plunger of a cold chamber die casting machine, the material being in the form of agglomerated particles of lubricant and a binder.

It is an object of this invention to provide a material for effectively lubricating the shot sleeve and plunger of a cold chamber die casting machine, the material including a source of carbon.

It is an object of this invention to provide a material for effectively lubricating the shot sleeve and plunger of a cold chamber die casting machine, the material being in the form of durable agglomerated particles suitable for metering by automatic dispensing equipment or by hand metering, the particles being sufficiently durable to maintain their size and integrity during normal shipping, storage and handling.

It is an object of this invention to provide a material for effectively lubricating the shot sleeve and plunger of a cold chamber die casting machine, the material being in the form of substantially non-caking particles.

Other objects and features will be in part apparent and in part pointed out hereinafter.

DETAILED DESCRIPTION OF THE PREFERRED EMBODIMENTS

It is believed that the material of this invention, when operating to lubricate the shot sleeves, advantageously has a fine powdery or granulated form that disperses to effectively lubricate the surfaces of the shot sleeve and plunger. In addition, prior to introduction to the shot sleeve, the material has a larger highly durable agglomerated form. Additionally, the lubricant of the present invention serves as an excellent lubricant between the shot sleeve interior walls and the plunger, and as a thermal barrier between the molten metal and the shot sleeve interior walls. The inorganic portion of the lubricant composition of the present invention does not flash off during the initial contact with the molten metal or the components of the shot sleeve that remain hot from the residual heat of the previous die casting cycle.

In operation, a lubricant according to the present invention is introduced into the shot sleeve at the beginning of each operating cycle. Because the lubricant of the present invention is resistant to caking, it can be introduced either manually or automatically from a dispensing apparatus. Furthermore, although the molten metal being cast is typically between about 1100° F. and 1600° F., for aluminum, for example, and despite any residual heat remaining in the shot sleeve or its components, a die casting process using the lubricant of the present invention may operate continuously with adequate lubrication over many cycles.

The solid lubricant preferably includes an inorganic high pressure lubricant which does not react with the molten metal, and can be utilized in a granulated form. Preferably, a lubricating composition includes an inorganic high pressure lubricant which accounts for about 10 to 75% of the agglomerate. Preferably, the inorganic lubricant is from about 20–60% of the agglomerate and especially about 30–50%. Preferably, nitrides, talcs, micas, silicas, graphite and other sources of carbon, including amorphous carbons such as carbon black, and sources of carbon such as starch and wood flour may be used as inorganic lubricants. Metal oxides, sulfur compounds, and phosphorus compounds, may also be used as inorganic lubricants. These kinds of powdered lubricants may be used solely or in combination, as known in the art. Suitable lubricant powders may be plastic resins such as polyethylene, polypropylene and similar polymers and waxes. These materials may be combined with inorganic high pressure lubricants such as talc, mica, spinel and mullite. Other lubricating materials such as molybdenum disulfide; and metal oxides such as $Na_2O$, MgO, AlN, $Al_2O_3$, $SiO_2$, CaO, $TiO_2$, $Fe_2O_3$, FeO, WC, TiN, TiC, $B_4C$, TiB, ZnC, SiC, $Si_3N_4$ may be added in small amounts of up to about 2% by weight, for example. Graphite and amorphous carbon such as carbon black may also be added, for example up to about 10% by weight. These inorganic lubricants may be used singly or in combinations with the other ingredients of the invention.

The aforementioned lubricant material is agglomerated with a binder material, preferably a water soluble binder, or aqueous emulsion. There is no special limitation to the binder material usable in the present invention, so long as it does not interfere with the lubricating ability of the agglomerate and has the retaining properties and binding abilities necessary for the agglomerate. Normally, up to about 10% by weight may be used, and preferably between about 2–8%. More specifically, polyvinyl alcohol, polyvinyl pyrrolidone, or polyethylene glycol may be present in some proportion as the binder material. Other materials may also be used in combination with these binders or singly. For example, carboxymethyl cellulose, hydroxy propyl cellulose, methylethyl cellulose and lignosulfonates, and other organic binders, may be used. Some additional inorganic binders, such as sodium silicate or other silicates may also be used in very small amounts, generally less than 1% by weight; such use is optional. It will be appreciated that the combination of ingredients and percentages of the binders is not critical, but the amounts and combinations should not be so large as to interfere with lubrication, as noted above. These materials may retain an equilibrium amount of water in the agglomerate, which may assist in distributing the lubricant in the shot sleeve.

The lubricating composition of the present invention includes an organic material with which the finely divided lubricant is agglomerated. The organic material generally occupies between about 10 to 50% by weight of the agglomerate. Preferably the organic material makes up between about 20 to 40% by weight of the total weight of the agglomerate. Preferably, thermoplastic natural and synthetic resins and waxes are used as the organic material, as noted herein. These organic resin compounds may be used solely or in combination with other organic materials. The organic and inorganic lubricant materials are agglomerated and hardened, by the binder or binders. Some materials, such as starch, carboxymethyl cellulose, methyethyl cellulose, and lignosulfonates may perform a dual function acting as a binder and also as a source of carbon, as described herein. Other lubricating materials, such as oils, fats and greases may be included, for example up to about 10% by weight. These oils, fats and greases may be selected from vegetable, animal and mineral sources, for example rapeseed oil, olive oil, fish oil, castor oil, soybean oil and the like. Further, other liquid lubricants may be included optionally. These materials may include polyhydric alcohols and the like which have lubricating properties. For example, glycerol, propylene glycol, ethylene glycol, sorbitol and similar materials may be optionally included.

It has been found that incorporation of these dual function materials, and other materials including wood particles, can provide an unexpected property to the resulting solid lubricant. These materials act as sources of lubricating carbon and have the function of lubricating the shot sleeve and plunger. The carbon is produced by the carbonizing and combustion of these materials. However, it is believed that these materials carbonize at a lower or slower rate than the organic materials commonly used in shot sleeve lubricants, and may reduce the flash rate of other combined organic materials, such as oils, fats, greases and waxes. Consequently, there is a greatly reduced amount of smoke and flame generated at the shot hole when the die lubricant of the invention is introduced into the shot sleeve, and the carbonizing occurs substantially within the closed confines of the shot sleeve, where it is effective to lubricate the shot sleeve and plunger. As a result, there is less pollution and waste. Typically, these low flash materials are included at up to about 60% by weight, preferably between about 3 and 30% by weight.

The agglomerated lubricants are durable and have considerable structural integrity. They preferably have a particle size distribution of about minus 6 to plus 50 U.S. mesh (3350–300 microns). The lubricants have a high order of resistance to caking and clumping and are resistant to abrasion, crushing and breakage, for example in transportation and handling. As a result, the size and integrity of the completed agglomerated lubricant is stable and consistent, presenting a reliable product both as a lubricant and a material which can be consistently metered, dispensed and monitored. Various materials produced in the examples herein were tested for durability. The test was conducted using a Patterson Kelley eight quart V-Blender. The blender was operated for three hours at 23 rpm, giving a total of 4140 revolutions or drops. Approximately 600 grams of material were used for each test. As shown in Table 1, very few fines were produced and only small changes occurred in the overall size distribution.

The invention may be further understood by reference to the following examples.

EXAMPLE 1

An agglomerated solid lubricant according to the invention was prepared as follows:

| DRY INGREDIENT | PARTS BY WEIGHT |
|---|---|
| Carbon Black (Cummins & Moore #938-325 mesh, −44 micron) | 10 |
| Polyethylene (Allied Signal 9A) | 33 |
| Starch (A. E. Staley PFP) | 30 |
| Wood Flour (American Wood Fibers Maple 20010) | 27 |

The above dry ingredients were premixed in a Patterson Kelley V-Blender for five minutes and then further blended in an INDCO five gallon bucket mixer with the following liquid ingredients:

| LIQUID INGREDIENT | PARTS BY WEIGHT |
|---|---|
| Polyethylene emulsion (Cook Composite and Polymers ESI-CRYL 2988, 35% solids, 65% water) | 10 |
| Polyvinyl alcohol solution (Air Products AIRVOL 21-205, 20% solids, 80% water) | 22.5 |
| Water | 45 |

The bucket mixer containing the dry solids was rotated at sixty RPM and was set with an initial inclination of 45° to the vertical. The liquid ingredients were blended together and sprayed into the rotating mixer. Mixing was continued for about seven minutes and the angle of the mixer was increased during mixing to about 60° to the vertical. The agglomerated product was removed and dried overnight at about 40–50° C. The dried product was screened to a particle distribution of −12 to +16 U.S. mesh size, for a first batch, and −16 to +30 U.S. mesh size, for a second batch. The agglomerated particles were hard and durable and exhibited excellent lubricity to the hand. Burn out tests in a 650° C. furnace, in air, exhibited a clean burn out with minimal flame.

EXAMPLE 2

An agglomerated solid lubricant according to the invention was made as described in Example 1, using the following ingredients:

| DRY INGREDIENT | PARTS BY WEIGHT |
|---|---|
| Carbon Black (#938) | 10 |
| Polyethylene (#9A) | 33 |
| Starch (PFP) | 15 |
| Wood Flour (20010) | 42 |

-continued

| | PARTS BY WEIGHT |
|---|---|
| LIQUID INGREDIENT | |
| Polyethylene Emulsion - (ESI-CRYL 2988) | 10 |
| Polyvinyl Alcohol Solution (AIRVOL 21-205, 20% solids) | 22.5 |
| Water | 49.7 |

The agglomerated particles were hard and durable and exhibited excellent lubricity to the hand. Burn out tests in a 650° C. furnace in air, exhibited a clean burn out with minimal flame.

EXAMPLE 3

An agglomerated solid lubricant according to the invention was made as described in Example 1, using the following ingredients:

| | PARTS BY WEIGHT |
|---|---|
| DRY INGREDIENT | |
| Talc (Luzenac America 2c) | 5 |
| Polyethylene (#9A) | 33 |
| Starch (PFP) | 35 |
| Wood Flour (20010) | 27 |
| Colorant (DAYGLO R6-PR5441) | .0025 |
| LIQUID INGREDIENT | |
| Polyethylene Emulsion - (ESI-CRYL 2988) | 10 |
| Polyvinyl Alcohol Solution (AIRVOL 21-205, 20%) | 22.5 |
| Water | 45 |

The agglomerated particles were hard and durable and exhibited excellent lubricity to the hand. Burn out tests in a 650° C. furnace, in air, exhibited a clean burn out with minimal flame.

EXAMPLE 4

An agglomerated solid lubricant was made using the following ingredients:

| | PARTS BY WEIGHT |
|---|---|
| DRY INGREDIENT | |
| Talc (2c) | 65 |
| Polyethylene (#9A) | 35 |
| Polyethylene glycol powder (Union Carbide Carbowax 8000) | 4.3 |
| Colorant (R6-PR5441) | 0.35 |
| LIQUID INGREDIENT | |
| Polyvinyl Alcohol Solution (AIRVOL 21-205, 20%) | 7.5 |
| Water | 18 |

The above dry ingredients were premixed in a Patterson Kelley V-Blender for five minutes and then agglomerated in a Mars Mineral Agglo-Miser pan pelletizer with the above liquid ingredients. The dry solids were fed to the pelletizer using a volumetric screw feeder. The liquid ingredients were blended together and sprayed into the pelletizer as the solids were introduced to the pan. The agglomerated product which exited the pan was dried overnight at about 40–50° C. The dried product was screened to a particle distribution of −6 to +50 U.S. Screen size. The agglomerated particles were hard and durable and exhibited excellent lubricity to the hand. Bumn out tests in a 650° C. furnace, in air, exhibited a clean burn out with minimal flame.

EXAMPLE 5

An agglomerated solid lubricant according to the invention was prepared as described in Example 4 as follows:

| | PARTS BY WEIGHT |
|---|---|
| DRY INGREDIENT | |
| Talc (2c) | 59 |
| Polyethylene (Allied Signal 9A) | 32 |
| Polyethylene glycol powder | 4 |
| Starch (A. E. Staley PFP) | 5 |
| Boron nitride (HPP-325) | 0.1 |
| Colorant (RG-PR5441) | 0.35 |
| LIQUID INGREDIENT | |
| Polyethylene emulsion (Cook Composite and Polymers ESI-CRYL 2988, 35% solids, 65% water) | 10 |
| Water | 13.5 |

The agglomerated particles were hard and durable and exhibited excellent lubricity to the hand. Burn out tests in a 650° C. furnace, in air, exhibited a clean burn out with minimal flame.

EXAMPLE 6

An agglomerated solid lubricant according to the invention was prepared as follows:

| DRY INGREDIENT | PARTS BY WEIGHT |
|---|---|
| Talc (2c) | 65 |
| Polyethylene (Allied Signal 9F) | 31 |
| Polyethylene glycol powder | 4 |
| Boron nitride (HPP-325) | 0.1 |
| Colorant (R6-PR5441) | 0.35 |

The above dry ingredients were premixed in an EIRICH 1.5 horsepower mixer for one minute and the mixed liquid ingredients were poured directly into the mixer with continued mixing on high speed for three minutes. Mixing was continued for an additional twelve minutes on slow speed.

| LIQUID INGREDIENT | PARTS BY WEIGHT |
|---|---|
| Polyvinyl alcohol solution (Airproducts AIRVOL 21-205, 20% solids, 80% water) | 7.2 |
| Water | 17.3 |

The agglomerated product was removed and dried overnight at about 40–50° C. The dried product was screened to a particle distribution of −12 to +16 U.S. Screen size, for a first batch, and −16 to +30 U.S. Screen size, for a second batch. The agglomerated particles were hard and durable and exhibited excellent lubricity to the hand. Burn out tests in a 650° C. furnace, in air, exhibited a clean burn out with minimal flame.

EXAMPLE 7

An agglomerated solid lubricant according to the invention was made as described in Example 6 using the following ingredients:

| | PARTS BY WEIGHT |
|---|---|
| DRY INGREDIENT | |
| Talc (2c) | 64 |
| Polyethylene (⅓ 9A, ⅔ 9F) | 32 |
| Boron nitride (HPP-325) | 0.1 |
| Colorant (R6-PR5441) | 0.35 |
| Polyethylene glycol powder | 4 |
| LIQUID INGREDIENT | |
| Polyvinyl Alcohol Solution, 20% | 6.9 |
| Water | 16.5 |

The agglomerated particles were hard and durable and exhibited excellent lubricity to the hand. Burn out tests in a 650° C. furnace, in air, exhibited a clean burn out with minimal flame.

EXAMPLE 8

An agglomerated solid lubricant according to the invention was made as described in Example 6, using the following ingredients:

| | PARTS BY WEIGHT |
|---|---|
| DRY INGREDIENT | |
| Talc (2c) | 55 |
| Polyethylene (¼ 9A, ¾ 9F) | 35 |
| Starch (PFP) | 5 |
| Carbon black (#938) | 10 |
| Polyethylene glycol powder | 4 |
| LIQUID INGREDIENT | |
| Polyvinyl Alcohol Solution (AIRVOL 21-205, 20%) | 8 |
| Water | 16 |

The agglomerated particles were hard and durable and exhibited excellent lubricity to the hand. Burn out tests in a 650° C. furnace, in air, exhibited a clean burn out with minimal flame.

PREPARATION OF PREMIXES

To increase the convenience of handling the low volume solid ingredients, and the liquid ingredients, two premixes were prepared. The dry premix was made by mixing the following ingredients in a Patterson Kelley V-Blender until uniform:

| INGREDIENT | PARTS BY WEIGHT |
|---|---|
| Talc (2c) | 52 |
| Boron Nitride (HHP-325) | 1.1 |
| Colorant (RG-PR5441) | 3.8 |
| Polyethylene glycol powder (Union Carbide 8000) | 43.1 |

The liquid premix was made by mixing the following:

| INGREDIENT | PARTS BY WEIGHT |
|---|---|
| Polyvinyl Alcohol Solution (20%) | 30 |
| Water | 70 |

EXAMPLE 9

An agglomerated solid lubricant according to the invention was made as described in Example 6, using the following ingredients:

| | PARTS BY WEIGHT |
|---|---|
| DRY INGREDIENT | |
| Talc (2c) | 54.2 |
| Polyethylene (⅓ Allied Signal, 9A, ⅔ Allied Signal 9F) | 33 |
| Dry premix | 9.3 |
| Starch (PFP) | 5 |
| LIQUID INGREDIENT | |
| Liquid premix | 22.9 |

The agglomerated particles were hard and durable and exhibited excellent lubricity to the hand. Burn out tests in a 650° C. furnace, in air, exhibited a clean burn out with minimal flame.

EXAMPLE 10

An agglomerated solid lubricant according to the invention was made as described in Example 6, using the following ingredients:

| | PARTS BY WEIGHT |
|---|---|
| DRY INGREDIENT | |
| Carbon Black (#938) | 3 |
| Polyethylene (⅓ 9A, ⅔ 9F) | 33 |
| Talc (2c) | 56 |
| Polyethylene glycol powder (8000) | 4 |
| LIQUID INGREDIENT | |
| Liquid premix | 22.3 |

Prior to drying, the agglomerated particles were dusted with a powder of talc and colorant at a level of an additional 2.7 parts talc and 0.35 parts R6-PR5441 colorant.

The agglomerated particles were hard and durable and exhibited excellent lubricity to the hand. Burn out tests in a 650° C. furnace, in air, exhibited a clean burn out with minimal flame.

EXAMPLE 11

An agglomerated solid lubricant according to the invention was made as described in Example 6, using the following ingredients:

| | PARTS BY WEIGHT |
|---|---|
| DRY INGREDIENT | |
| Talc (2c) | 52 |
| Polyethylene (¼ 9A, ¾ 9F) | 34 |
| Starch (PFP) | 5 |
| Dry premix | 9.28 |
| LIQUID INGREDIENT | |
| Polyvinyl Alcohol Solution (12%) | 5.43 |
| Blown rapeseed oil (30% oil, napthenic oil blend 64% water, emulsifier) (Franlube 3600WSH, trademark) | 17.9 |

The agglomerated particles were hard and durable and exhibited excellent lubricity to the hand. Burn out tests in a 650° C. furnace, in air, exhibited a clean burn out with minimal flame.

EXAMPLE 12

An agglomerated solid lubricant according to the invention was made as described in Example 6, using the following ingredients:

| | PARTS BY WEIGHT |
|---|---|
| DRY INGREDIENT | |
| Talc (2c) | 57 |
| Polyethylene (¼ 9A, ¾ 9F) | 34 |
| Starch (PFP) | 5 |
| Boron nitride (HPP-325) | 0.1 |
| Polyethylene glycol powder (8000) | 4 |
| Colorant (R6-PR5441) | 0.35 |
| LIQUID INGREDIENT | |
| Polyvinyl Alcohol Solution (20%) | 7 |
| Emulsified olive oil (12.9% oil, 85.8% water, emulsifier) | 12.3 |

The agglomerated particles were hard and durable and exhibited excellent lubricity to the hand. Burn out tests in a 650° C. furnace, in air, exhibited a clean burn out with minimal flame.

EXAMPLE 13

An agglomerated solid lubricant according to the invention was made as described in Example 6, using the following ingredients:

| | PARTS BY WEIGHT |
|---|---|
| DRY INGREDIENT | |
| Talc (2c) | 51 |
| Polyethylene (¼ 9A, ¾ 9F) | 32.5 |
| Starch (PFP) | 4.7 |
| Graphite (Asbury 3560) | 8.1 |
| Polyethylene glycol powder (8000) | 3.7 |
| LIQUID INGREDIENT | |
| Polyvinyl Alcohol Solution (6%) | 23.8 |

The agglomerated particles were hard and durable and exhibited excellent lubricity to the hand. Burn out tests in a 650° C. furnace, in air, exhibited a clean burn out with minimal flame.

EXAMPLE 14

An agglomerated solid lubricant was prepared by combining the materials of Examples 12 and 13 in equal parts by weight. The combined lubricant exhibited excellent lubricity to the hand.

EXAMPLE 15

An agglomerated solid lubricant according to the invention was made as described in Example 6, using the following ingredients:

| | PARTS BY WEIGHT |
|---|---|
| DRY INGREDIENT | |
| Talc (2c) | 47 |
| Polyethylene (¼ 9A, ¾ 9F) | 34 |
| Starch (PFP) | 5 |
| Graphite (3560) | 10 |
| Polyethylene glycol powder (Carbowax 8000 Union Carbide) | 4 |
| LIQUID INGREDIENT | |
| Polyvinyl Alcohol Solution (AIRVOL 21-205, 15%) | 8 |
| Blown rapeseed/napthenic oil blend (Franlube 3600WSH) | 16 |

The agglomerated particles were hard and durable and exhibited excellent lubricity to the hand. Burn out tests in a 650° C. furnace, in air, exhibited a clean burn out with minimal flame.

EXAMPLE 16

An agglomerated solid lubricant according to the invention was made as described in Example 6, using the following ingredients:

| | PARTS BY WEIGHT |
|---|---|
| DRY INGREDIENT | |
| Talc (2c) | 47 |
| PolyethyLene (¼ 9A, ¾ 9F) | 34 |
| Starch (PFP) | 5 |
| Graphite (Asbury 3560) | 10 |
| Polyethylene glycol powder (8000) | 4 |
| LIQUID INGREDIENT | |
| Polyvinyl Alcohol Solution (AIRVOL 21-205, 15%) | 8 |
| Olive oil emulsion | 16 |

The agglomerated particles were hard and durable and exhibited excellent lubricity to the hand. Burn out tests in a 650° C. furnace, in air, exhibited a clean burn out with minimal flame.

EXAMPLE 17

An agglomerated solid lubricant according to the invention was made as described in Example 6, using the following ingredients:

| | PARTS BY WEIGHT |
|---|---|
| DRY INGREDIENT | |
| Talc (2c) | 47 |
| Polyethylene (¼ 9A, ¾ 9F) | 34 |
| Starch (PFP) | 5 |
| Graphite (3560) | 10 |
| Polyethylene glycol powder (8000) | 4 |
| LIQUID INGREDIENT | |
| Polyvinyl Alcohol Solution (AIRVOL 21-205, 15%) | 8 |
| Soybean oil emulsion (22.5% oil, 75.2% water, balance emulsifier) | 16 |

The agglomerated particles were hard and durable and exhibited excellent lubricity to the hand. Burn out tests in a 650° C. furnace, in air, exhibited a clean burn out with minimal flame.

EXAMPLE 18

An agglomerated solid lubricant according to the invention was made as described in Example 6, using the following ingredients:

| | PARTS BY WEIGHT |
|---|---|
| DRY INGREDIENT | |
| Talc (2c) | 47 |
| Polyethylene (¼ 9A, ¾ 9F) | 34 |
| Starch (PFP) | 5 |
| Graphite | 10 |
| Polyethylene glycol powder | 4 |
| LIQUID INGREDIENT | |
| Polyvinyl Alcohol Solution (AIRVOL 21-205, 15%) | 8 |
| PL-44 (trademark) oil emulsion, LaFrance Manufacturing Co., St. Louis, Missouri | 16 |

The agglomerated particles were hard and durable and exhibited excellent lubricity to the hand. Burn out tests in a 650° C. furnace, in air, exhibited a clean burn out with minimal flame.

EXAMPLE 19

An agglomerated solid lubricant was prepared as follows:

| | PARTS BY WEIGHT |
|---|---|
| DRY INGREDIENT | |
| Talc (2c) | 57 |
| Polyethylene (9A) | 8.5 |
| Polyethylene (9F) | 25.5 |
| Starch (PFP) | 5 |
| Polyethylene glycol powder (8000) | 4 |
| Colorant (RG-PR5441) | 0.35 |
| LIQUID INGREDIENT | |
| Polyvinyl Alcohol Solution (AIRVOL 21-205, 20%) | 5.32 |

-continued

| | PARTS BY WEIGHT |
|---|---|
| 30% olive oil emulsion with Neodol 1-5 | 17.90 |
| Water | 2.67 |

The above dry ingredients were premixed in an EIRICH 1.5 horsepower mixer for one minute. The mixed liquids, minus the oil emulsion, were poured directly into the mixer with continued mixing on high speed for three minutes after addition of the liquids. Mixing was continued for an additional three and one-half minutes on high speed with the addition of the oil emulsion by spraying into the mixer during mixing. After addition of the emulsion, mixing was continued for an additional two minutes on slow speed to complete the agglomeration of the ingredients.

EXAMPLE 20

An agglomerated solid lubricant according to the invention was made as described in Example 19, using the following ingredients:

| | PARTS BY WEIGHT |
|---|---|
| DRY INGREDIENT | |
| Talc (2c) | 52 |
| Polyethylene (9A) | 8.5 |
| Polyethylene (9F) | 22.5 |
| Starch (PFP) | 5 |
| Graphite (3560) | 5 |
| Polyethylene glycol powder (8000) | 4 |
| Polypropylene (FP 800.00) | 3 |
| Boron Nitride (HPP-325) | 0.1 |
| LIQUID INGREDIENT | |
| Blown rapeseed/napthenic oil emulsion (3600 WSH) | 17.90 |
| Polypropylene/water emulsion (Michem Fiberglas X2, 35% solids) | 4.51 |
| Water | 5.74 |

The agglomerated particles were hard and durable and exhibited excellent lubricity to the hand. Burn out tests in a 650° C. furnace, in air, exhibited a clean burn out with minimal flame.

EXAMPLE 21

An agglomerated solid lubricant according to the invention was made as described in Example 19, using the following ingredients:

| | PARTS BY WEIGHT |
|---|---|
| DRY INGREDIENT | |
| Talc (2c) | 58 |
| Polyethylene (AC-9A) | 8.5 |
| Polyethylene (International Group, Polyset 2015 60–70 micron) | 25.5 |
| Starch (PFP) | 5 |
| Polypropylene (Equistar FP-800.00 20 micron) | 3.0 |
| Colorant (RG-PR5441) | 0.35 |

-continued

| | PARTS BY WEIGHT |
|---|---|
| LIQUID INGREDIENT | |
| Polyvinyl Alcohol Solution (AIRVOL 21-205, 20%) | 5.48 |
| Blown rapeseed/napthenic oil emulsion (3600 WSH) | 17.90 |
| Polypropylene/water emulsion (Michem 43040, 40% solids) | 5.25 |
| Water | 1.00 |

The agglomerated particles were hard and durable and exhibited excellent lubricity to the hand. Burn out tests in a 650° C. furnace, in air, exhibited a clean bum out with minimal flame.

EXAMPLE 22

An agglomerated solid lubricant according to the invention was made as described in Example 19, using the following ingredients:

| | PARTS BY WEIGHT |
|---|---|
| DRY INGREDIENT | |
| Talc (2c) | 52.75 |
| Polyethylene (9F) | 23.75 |
| Polyethylene (9A) | 8.5 |
| Starch (PFP) | 5 |
| Graphite (3560) | 5 |
| Polyethylene glycol powder (8000) | 2 |
| Polypropylene (Equistar FP800.00, 20 micron) | 3 |
| LIQUID INGREDIENT | |
| Polyvinyl Alcohol Solution (AIRVOL 21-205, 20% solids) | 5.45 |
| Water | 0.5 |
| Blown rapeseed oil/napthenic oil emulsion (3600 WSH) | 17.90 |
| Polypropylene/water emulsion (Michem 42035, 35% solids) | 5.25 |

The agglomerated particles were hard and durable and exhibited excellent lubricity to the hand. Burn out tests in a 650° C. furnace, in air, exhibited a clean burn out with minimal flame.

The lubricants containing polypropylene resin have especially good lubricating properties. They are particularly good at preventing metal blow by around the plunger and they have tenacious lubricating properties. These features are especially helpful with worn plunger and shot sleeve combinations and with water cooled plungers in particular. In addition, these lubricants provide a safety factor, in case application of lubricant is interrupted for a time during the die casting process, several cycles for example, as residual lubricity may remain from prior application of lubricant. Up to 10% by weight of the lubricant, or more, may be polypropylene resin. Preferably polypropylene resin may be from about 1 to 6% by weight of the total lubricant. The particular proportion is not critical so long as effective lubrication is provided by the entire combination of the lubricant.

TABLE 1

| Material | US Std. Mesh Size | Original (g) | Original % | Tumbled (g) | Tumbled % | Change |
|---|---|---|---|---|---|---|
| Example 11 | +16 | 4.5 | 0.73 | 2.1 | 0.34 | −0.39 |
| Test 1 | 16+30 | 195.6 | 31.73 | 189.5 | 30.79 | −0.93 |
| | −30+50 | 326 | 52.88 | 333.9 | 54.26 | 1.38 |
| | −50+70 | 75.6 | 12.26 | 75.6 | 12.28 | 0.02 |
| | −70 | 14.8 | 2.40 | 14.3 | 2.32 | −0.08 |
| | | 616.5 | | 615.4 | | |
| Example 11 | +16 | 3.7 | 0.63 | 3.1 | 0.53 | −0.10 |
| Test 2 | −16+30 | 215.4 | 36.86 | 211.1 | 36.19 | −0.67 |
| | −30+50 | 295.4 | 50.55 | 296.6 | 50.85 | 0.30 |
| | −50+70 | 56.9 | 9.74 | 59.4 | 10.18 | 0.45 |
| | −70 | 13 | 2.22 | 13.1 | 2.25 | 0.02 |
| | | 584.4 | | 583.3 | | |
| Example 8 | +16 | 7.1 | 1.21 | 4.4 | 0.75 | −0.46 |
| Test 1 | −16+30 | 208.7 | 35.71 | 170.5 | 29.23 | −6.48 |
| | −30+50 | 306.5 | 52.45 | 309.5 | 53.06 | 0.61 |
| | −50+70 | 18.2 | 3.11 | 40.8 | 6.99 | 3.88 |
| | −70 | 7.2 | 1.23 | 21.1 | 3.62 | 2.39 |
| | | 547.7 | | 546.3 | | |
| Example 8 | +16 | 6 | 1.03 | 4.1 | 0.70 | −0.32 |
| Test 2 | −16+30 | 202.2 | 34.60 | 163.3 | 28.00 | −6.60 |
| | −30+50 | 313 | 53.56 | 317.9 | 54.50 | 0.94 |
| | −50+70 | 16.8 | 2.87 | 38.9 | 6.67 | 3.79 |
| | −70 | 6.9 | 1.18 | 19.5 | 3.34 | 2.16 |
| | | 544.9 | | 543.7 | | |
| Example 10 | +16 | 3.3 | 0.56 | 2.8 | 0.48 | −0.08 |
| | −16+30 | 199.7 | 34.17 | 183.1 | 31.39 | −2.78 |
| | −30+50 | 294.5 | 50.39 | 286.5 | 49.12 | −1.28 |
| | −50+70 | 60.5 | 10.35 | 70.5 | 12.09 | 1.73 |
| | −70 | 22.7 | 3.88 | 33.9 | 5.81 | 1.93 |
| | | 580.7 | | 576.8 | | |

Those skilled in the art will appreciate that the examples given herein are to illustrate the invention. Various modifications may be made to the details disclosed without departing from the spirit of the invention. The scope of the invention is to be limited only by the appended claims and their equivalents.

I claim:

1. A non-caking low flash lubricant for use in lubricating the shot sleeve of a machine for die casting molten metals, the lubricant being an agglomerate comprising agglomerated particles that include an inorganic high pressure lubricant agglomerated with organic material, the organic material including a low flash material providing a source of lubricating carbon on exposure to heat, the organic material including polypropylene as a portion of the organic material, the agglomerate further comprising a binder material in an amount effective to form the agglomerate and to create a stable agglomerated structure.

2. The lubricant of claim 1 wherein the low flash material is selected from the group consisting of wood particles, cellulose, modified cellulose, lignins and starches.

3. The lubricant of claim 1 wherein the low flash material is selected from the group consisting of wood flour and starch.

4. The lubricant of claim 1 wherein the low flash material is carboxymethyl cellulose.

5. The lubricant of claim 1 wherein the inorganic high pressure lubricant is selected from the group consisting of boron nitride, talc, mica, silica, amorphous carbon, graphite and molybdenum disulfide.

6. The lubricant of claim 1 wherein the binder material is an organic binder.

7. The lubricant of claim 1 wherein the organic material includes additional organic resins.

8. The lubricant of claim 7 wherein the organic resins are thermoplastic resins.

9. A non-caking, low flash solid lubricant for lubricating the shot sleeve of a cold chamber die casting machine, the lubricant comprising agglomerated particles, the agglomerated particles containing about 10–75% by weight of inorganic high pressure lubricant, about 20–60% by weight of organic lubricating material, the organic material including low flash material providing a source of lubricating carbon on exposure to heat and a binder material, the binder material being effective to form the agglomerate and create a stable agglomerated structure, the organic material also including an organic polymer selected from the group consisting of natural and synthetic waxes and thermoplastic resins, the organic polymer comprising about 10–50% by weight of the agglomerated particles, the organic polymer further including polypropylene resin as a portion of the organic polymer, the lubricant being effective to lubricate the shot sleeve of a cold chamber die casting machine while producing a reduced generation of smoke and flame flashing at the shot hole of the shot sleeve on introduction of the lubricant.

10. The lubricant of claim 9 wherein the lubricant contains up to about 10% by weight of a lubricating oil.

11. The lubricant of claim 10 wherein the oil is absorbed into the agglomerated lubricant.

12. The lubricant of claim 10 wherein the lubricant particles are about minus 6 to plus 50 U.S. Mesh size.

13. The lubricant of claim 10 wherein the agglomerated particles are dusted with a powder to resist caking.

14. The lubricant of claim 10 wherein the oil is selected from the group consisting of olive oil, rapeseed oil, soybean oil, fish oil, caster oil and mineral oil.

15. The lubricant of claim 9 wherein the low flash material is selected from the group consisting of wood particles, cellulose, modified cellulose, lignins and starches.

16. The lubricant of claim 9 wherein the low flash material is selected from the group consisting of wood flour and starch.

17. The lubricant of claim 9 wherein the inorganic high pressure lubricant is selected from the group consisting of boron nitride, talc, mica, silica, carbon and molybdenum disulfide.

18. The lubricant of claim 9 wherein the binder is an organic binder selected from the group consisting of polyvinyl alcohol, polyethylene glycol, starch, modified starch, carboxymethyl cellulose, methylethyl cellulose and lignosulfonates.

19. The lubricant of claim 9 wherein the polypropylene is present at between about 1 and 6% by weight of the lubricant.

20. A non-caking, low flash solid lubricant comprising an agglomerate comprising agglomerated particles, the agglomerated particles containing about 10–75% by weight of inorganic high pressure lubricant; about 10–50% by weight of an organic polymer selected from the group consisting of natural and synthetic waxes and thermoplastic resins; the organic polymer further including polypropylene resin as a portion of the organic polymer, the polypropylene being present at between about 1 and 6% by weight of the lubricant; about 3–30% by weight of a low flash material providing a source of lubricating carbon on exposure to heat, the low flash material being selected from the group consisting of wood particles, cellulose, modified cellulose, lignins and starch; up to about 10% by weight of lubricating oil, fat or greases; and up to about 10% by weight of binder effective to form the agglomerate and create a stable agglomerated structure; the agglomerated particles being about minus 6 to plus 50 U.S. Mesh size and having a dusted powder coating.

21. A lubricant composition comprising a particulate inorganic high pressure lubricant, an organic material and a binder that agglomerates the particulate inorganic high pressure lubricant with the organic material.

* * * * *